US011600415B2

(12) United States Patent
Song et al.

(10) Patent No.: US 11,600,415 B2
(45) Date of Patent: Mar. 7, 2023

(54) SUPERCONDUCTING MAGNET SYSTEM FOR CYCLOTRON AND CYCLOTRON COMPRISING IHE SAME

(71) Applicants: HEFEI CAS ION MEDICAL AND TECHNICAL DEVICES CO., LTD., Hefei (CN); HEFEI INSTITUTE OF PHYSICAL SCIENCE, CHINESE ACADEMY OF SCIENCES, Hefei (CN)

(72) Inventors: Yuntao Song, Hefei (CN); Kaizhong Ding, Hefei (CN); Shuangsong Du, Hefei (CN); Yonghua Chen, Hefei (CN); Rui Hu, Hefei (CN); Lei Li, Hefei (CN); Yanfang Bi, Hefei (CN); Huahui Zhang, Hefei (CN); Chunlong Zou, Hefei (CN); Jun Li, Hefei (CN)

(73) Assignees: HEFEI CAS ION MEDICAL AND TECHNICAL DEVICES CO., LTD., Hefei (CN); HEFEI INSTITUTE OF PHYSICAL SCIENCE, CHINESE ACADEMY OF SCIENCES, Hefei (CN)

( * ) Notice: Subject to any disclaimer, the term of this patent is extended or adjusted under 35 U.S.C. 154(b) by 0 days.

(21) Appl. No.: 17/866,431

(22) Filed: Jul. 15, 2022

(65) Prior Publication Data

US 2022/0367095 A1 Nov. 17, 2022

Related U.S. Application Data

(63) Continuation of application No. PCT/CN2021/126379, filed on Oct. 26, 2021.

(30) Foreign Application Priority Data

Aug. 25, 2021 (CN) ..... 202110986505.X

(51) Int. Cl.
*H01F 6/04* (2006.01)
*F25D 19/00* (2006.01)
(Continued)

(52) U.S. Cl.
CPC ..... *H01F 6/04* (2013.01); *F25D 19/00* (2013.01); *H01F 6/02* (2013.01); *H01F 6/06* (2013.01)

(58) Field of Classification Search
CPC ..... F28D 19/00; F28D 19/003; F28D 19/006; H01F 6/02; H01F 6/04; H01F 6/06; H01F 6/065
See application file for complete search history.

(56) References Cited

U.S. PATENT DOCUMENTS 5,721,523 A 2/1998 Dorri et al.
2015/0111753 A1 4/2015 Nakagawa et al.
(Continued)

FOREIGN PATENT DOCUMENTS

CN 101144657 A 3/2008
CN 102460610 A 5/2012
(Continued)

*Primary Examiner* — Nael N Babaa

(57) ABSTRACT

A superconducting magnet system and a cyclotron using the same. The superconducting magnet system includes a cryogenic device, a superconducting device and a protecting module. The cryogenic device includes a refrigerating machine and a cryogenic container assembly. The cryogenic container assembly includes a first container end, a connecting tube and a second container end. The first container end is communicated with the second container end through the connecting tube. The superconducting device includes a superconducting coil arranged in the first container end and immersed in a liquid or gaseous cooling medium. The protecting module is connected to the superconducting coil
(Continued)

and is configured to protect the superconducting coil if the superconducting coil suffers a quench.

18 Claims, 6 Drawing Sheets

(51) Int. Cl.
*H01F 6/02* (2006.01)
*H01F 6/06* (2006.01)

(56) References Cited

U.S. PATENT DOCUMENTS

| | | | | |
|---|---|---|---|---|
| 2016/0381780 | A1* | 12/2016 | Subotic | H01F 5/02 313/62 |
| 2019/0024950 | A1* | 1/2019 | Ebara | F25B 9/14 |

FOREIGN PATENT DOCUMENTS

| | | | |
|---|---|---|---|
| CN | 103247406 | A | 8/2013 |
| CN | 107481831 | A | 12/2017 |
| JP | H09312210 | A | 12/1997 |
| JP | 2001004236 | A | 1/2001 |
| JP | 2001004237 | A | 1/2001 |

* cited by examiner

SUPERCONDUCTING MAGNET SYSTEM FOR CYCLOTRON AND CYCLOTRON COMPRISING IHE SAME

CROSS-REFERENCE TO RELATED APPLICATIONS

This application is a continuation of International Patent Application No. PCT/CN2021/126379, filed on Oct. 26, 2021, which claims the benefit of priority from Chinese Patent Application No. 202110986505.X, filed on Aug. 25, 2021. The content of the aforementioned application, including any intervening amendments thereto, is incorporated herein by reference in its entirety.

TECHNICAL FIELD

This application relates to superconducting magnet, and more particularity to a superconducting magnet system for cyclotrons and a cyclotron comprising the same.

BACKGROUND

Compared to conventional radiotherapy, proton therapy can more precisely target tumors to maximize the proton beam energy delivered to the tumor and minimize the dose to surrounding normal tissues. Cyclotron is a core part of a proton therapy instrument, which can accelerate heavy charged particles and increase the particle energy. Inside the cyclotron, a superconducting magnet system is employed to provide a confining magnetic field for particle acceleration. Compared to ordinary magnets, the superconducting magnet system can significantly reduce the size of the cyclotron and make the overall structure more compact. Under the same ring radius, an extracted energy of the cyclotron with the superconducting magnet system can be magnified several times. In addition, the superconducting magnet system can also bring less power consumption and lower operation cost. Therefore, the superconducting magnet technology has long attracted a lot of attention.

Regarding the existing superconducting magnet systems, a refrigerating machine is generally arranged close to a magnet, and thus the refrigerating machine is susceptible to magnetic interference. In view of this, a magnetic shielding structure is required, making the superconducting magnet system more structurally complex.

SUMMARY

In order to solve the above-mentioned problems, the present disclosure provides a superconducting magnet system for cyclotrons, which has a simple structure and can resist an electromagnetic interference.

The present disclosure also provides a cyclotron comprising the superconducting magnet system.

In a first aspect, the present disclosure provides a superconducting magnet system for cyclotrons, comprising:

a cryogenic device;

a superconducting device; and a protecting module;

wherein the cryogenic device comprises a refrigerating machine and a cryogenic container assembly; the cryogenic container assembly is filled with a cooling medium; the cryogenic container assembly comprises a first container end, a first connecting tube and a second container end; a magnet is provided at the first container end; the refrigerating machine is arranged at the second container end, and configured to cooling the cooling medium in the cryogenic container assembly; and the first container end is communicated with the second container end through the first connecting tube;

the superconducting device comprises a superconducting coil; the superconducting coil is arranged in the first container end, and is immersed in the cooling medium in the first container end; and the cooling medium is a liquid cooling medium or a gaseous cooling medium; and the protecting module is connected to the superconducting coil, and is configured to protect the superconducting coil when the superconducting device suffers a quench.

The superconducting magnet system provided herein can ensure a stability of the cryogenic device and reduce an electromagnetic interference of the superconducting coil to the refrigerating machine and various electrical components arranged at the second container end, thus the superconducting magnet system is free from magnetic shielding and has reduced costs. Meanwhile, during a forging of magnetism, the superconducting coil can be cooled under the circulation of a gaseous cooling medium to reduce the recovery cost after multiple quenches. During the normal operation, the superconducting coil can be cooled by immersion in a liquid cooling medium to ensure the sufficient cooling and stable operation.

In some embodiments, the cryogenic container assembly comprises a Dewar, a cold shield and a liquid helium container nested in sequence from outside to inside; the Dewar, the cold shield and the liquid helium container are separated from each other; a first vacuum cavity is defined between an inner surface of the Dewar and an outer surface of the cold shield; a second vacuum cavity is defined between an inner surface of the cold shield and an outer surface of the liquid helium container; and the liquid helium container is filled with the cooling medium;

the Dewar comprises a first Dewar portion, a second Dewar portion and a second connecting tube; the first Dewar portion is connected to the second Dewar portion through the second connecting tube; the cold shield comprises a first cold shield portion, a second cold shield portion and a third connecting tube; the first cold shield portion is connected to the second cold shield portion through the third connecting tube; the liquid helium container comprises a first liquid helium container portion, a second liquid helium container portion and a fourth connecting tube; and the first liquid helium container portion is connected to the second liquid helium container portion through the fourth connecting tube; and the first liquid helium container portion is nestedly arranged inside the first cold shield portion, and the first cold shield portion is nestedly arranged inside the first Dewar portion; the first Dewar portion, the first cold shield portion and the first liquid helium container portion together form the second container end of the cryogenic container assembly; the second connecting tube, the third connecting tube and the fourth connecting tube are nested in sequence from outside to inside to form the first connecting tube; the second liquid helium container portion is nestedly arranged inside the second cold shield portion, and the second cold shield portion is nestedly arranged inside the second Dewar portion; and the second Dewar portion, the second cold shield portion and the second liquid helium container portion together form the first container end of the cryogenic container assembly.

In some embodiments, the superconducting magnet system further comprises a pressure relief assembly and/or a vacuum relief assembly;

wherein the pressure relief assembly is a pressure sensor, a pressure gauge, a safety valve, a cryogenic explosive actuated valve or a combination thereof; a pressure pipe is connected to the first liquid helium container portion; the pressure pipe successively passes through the first cold shield portion and the first Dewar portion; and the pressure relief assembly is arranged on the pressure pipe and placed outside the first Dewar portion; and the vacuum safety assembly is a vacuum explosive actuated valve, a vacuum gauge or a combination thereof; and the vacuum safety assembly is arranged on the first Dewar portion.

In some embodiments, the superconducting device further comprises a current lead; the current lead is arranged at the second container end, and connected in series with the superconducting coil; and the refrigerating machine comprises a primary cold head and a secondary cold head; the primary cold head is configured to cool the first cold shield portion and a heat sink of the current lead by means of thermal conduction; and the secondary cold head is configured to cool the cooling medium in the liquid helium container.

In some embodiments, the refrigerating machine further comprises a heat exchange tube configured to perform heat exchange with the primary cold head; the heat exchange tube is filled with the cooling medium; the heat exchange tube extends along the third connecting tube and an outer surface of the second cold shield portion to form a heat exchange loop; and the primary cold head is configured to cool the third connecting tube and the second cold shield portion through the heat exchange tube and the cooling medium in the heat exchange tube.

In some embodiments, the superconducting device further comprises a pull rod assembly; and the pull rod assembly is connected to the second liquid helium container portion, and configured to adjust a position of the second liquid helium container portion.

In some embodiments, the pull rod assembly comprises a plurality of pull rod groups; each of the plurality of pull rod groups comprises a plurality of pull rods arranged in the same plane; planes in which the plurality of pull rod groups are respectively located are perpendicular to each other; one end of each of the plurality of pull rods is fixedly arranged on the second liquid helium container portion, and the other end of each of the plurality of pull rods passes through the second cold shield portion and the second Dewar portion, and is provided with an adjustment nut; and the adjustment nut is configured to fix each of the plurality of pull rods to the second Dewar portion and to adjust a position of the second liquid helium container portion relative to the second Dewar portion in an axial direction of each of the plurality of pull rods.

In some embodiments, the superconducting coil comprises a first coil and a second coil both arranged along a radial direction; the first coil is arranged radially inside the second coil; and a copper-to-superconductor ratio of a superconducting wire of the second coil is greater than that of a superconducting wire of the first coil, wherein with regard to the superconducting wire of the second coil and the superconducting wire of the first coil, the copper-to-superconductor ratio is a volume ratio of copper to superconducting material.

In some embodiments, the superconducting magnet system further comprises a superconducting power supply;

wherein the superconducting power supply is connected to the superconducting coil through a current lead, and configured to perform excitation and demagnetization on the superconducting coil.

In some embodiments, the protecting module comprises a fast discharge resistor; the fast discharge resistor is connected in parallel to two ends of the superconducting power supply; and a resistance of the fast discharge resistor is 0.2-0.3Ω; and the superconducting magnet system further comprises a controller; and the controller is configured to disconnect the superconducting coil from the superconducting power supply to allow the superconducting coil to be connected in series with the fast discharge resist when the superconducting coil suffers a quench.

In some embodiments, the controller is configured to determine that the superconducting coil is suffering a quench when a ratio of a segmented voltage to a total voltage of the superconducting coil exceeds a preset threshold.

In some embodiments, the superconducting coil comprises a plurality of section coils; the protecting module comprises a bidirectional diode; and the bidirectional diode is arranged in parallel at two ends of each of the plurality of section coils;

In a second aspect, the present disclosure provides a cyclotron, comprising the above-mentioned superconducting magnet system.

The cyclotron provided herein is provided with the above-mentioned superconducting magnet system, such that an overall performance of the cyclotron is developed.

Advantages and aspects of the present application will be apparent upon review of the following detailed description.

Figure 1:
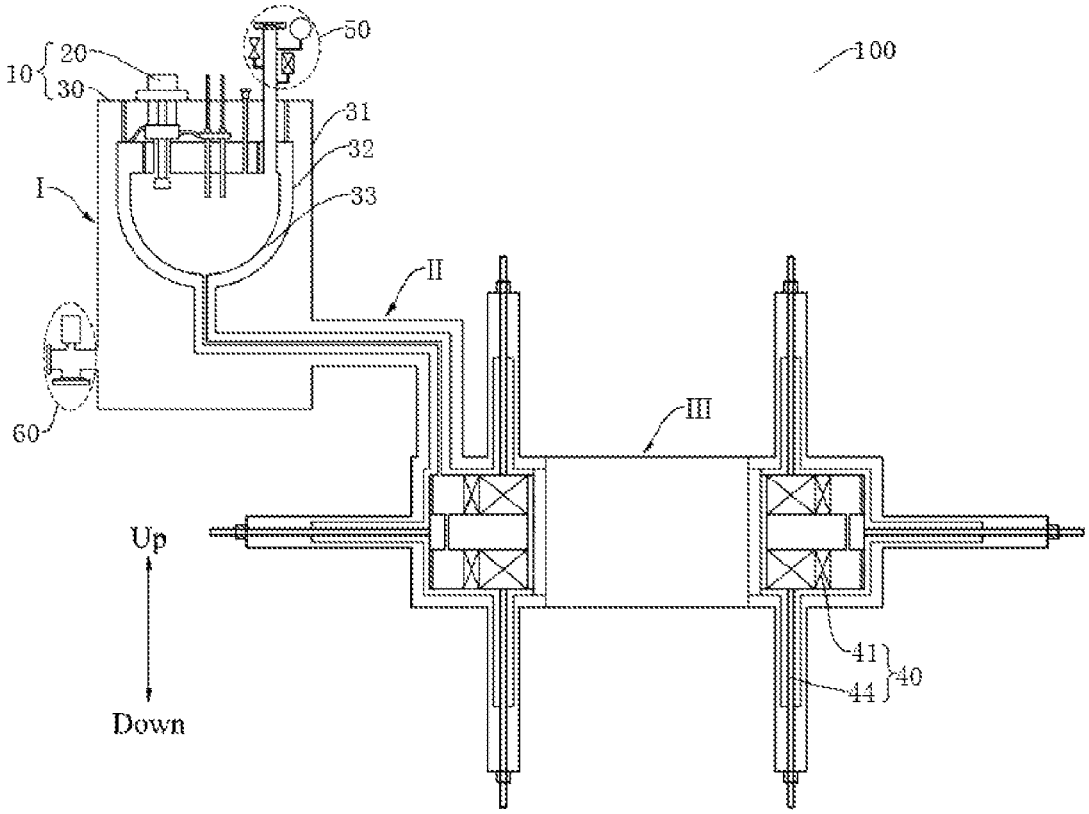
FIG. 1 schematically depicts a superconducting magnet system for cyclotrons according to an embodiment of the present disclosure.

In the drawings, 100, superconducting magnet system; 10, cryogenic device; 20, refrigerating machine; 21, primary cold head; 211, copper sheet; 212, copper braid; 22, secondary cold head; 24, heat exchange tube; 25, thermal conducting part; 30, cryogenic container assembly; I, first container end; I I, first connecting tube; I I I, second container end; 301, first vacuum cavity; 302, second vacuum cavity; 31, Dewar; 311, first Dewar portion; 3111, first flange; 312, second Dewar portion; 313, second connecting tube; 314, Dewar pull rod portion; 32, cold shield; 321, first cold shield portion; 3211, second flange; 322, second cold shield portion; 323, third connecting tube; 324, cold shield pull rod portion; 33, liquid helium container; 331, first liquid helium container portion; 3311, third flange; 332, second liquid helium container portion; 333, fourth connecting tube;

34, first support rod; 35, second support rod; 40, superconducting device; 41, superconducting coil; 411, first coil; 412, second coil; 42, current lead; 43, heat sink; 44, pull rod assembly; 441, pull rod; 442, adjustment nut; 45, frame; 46, closing plate; 47, binding wire; 48, aviation connector; 50, pressure relief assembly; 51, pressure sensor; 52, pressure gauge; 53, safety valve; 54, cryogenic explosive actuated valve; 55, pressure pipe; 60, vacuum relief assembly; 61, vacuum explosive actuated valve; 62, vacuum gauge; 63, vacuum tube; and 631, vacuum-pumping port.

DETAILED DESCRIPTION OF EMBODIMENTS

Technical solutions of the present disclosure and the prior art will be described below with reference to the accompany drawings and embodiments. Throughout the drawings, the same or similar reference numerals refer to identical or functionally similar elements. It should be noted that described below are merely illustrative of the present disclosure, and not intended to limit the present disclosure.

Illustrated in FIGS. 1-6 is a superconducting magnet system 100 for cyclotrons according to an embodiment of the disclosure.

Referring to FIG. 1, the superconducting magnet system 100 includes a cryogenic device 10, a superconducting device 40 and a protecting module.

Specifically, as shown in FIG. 1, the cryogenic device 10 includes a refrigerating machine 20 and a cryogenic container assembly 30. The cryogenic container assembly 30 is filled with a cooling medium. In an embodiment, the cooling medium is liquid helium or gaseous helium. For example, by means of a refrigerant, the cooling medium in the cryogenic container assembly 30 can change between liquid state and gaseous state. Therefore, a cooling capacity of the refrigerating machine 20 can be controlled according to a needed cooling capacity of the superconducting device 40, so as to control a physical state of the cooling medium in the cryogenic container assembly 30.

The cryogenic container assembly 30 includes a first container end I I I, a first connecting tube I I and a second container end I. The refrigerating machine 20 is arranged at the second container end I, and configured to cooling the cooling medium in the cryogenic container assembly 30. The first container end I I I is communicated with the second container end I through the first connecting tube I I. The superconducting device 40 includes a superconducting coil 41. The superconducting coil 41 is arranged in the first container end I I I, and is immersed in the cooling medium in the first container end I I I, where the cooling medium is liquid or gaseous, that is, the superconducting coil 41 can be immersed in a liquid cooling medium in the first container end I I I or in a gaseous cooling medium in the first container end I I I.

For example, when the superconducting device 40 needs to be trained by multiple quenches, the cooling medium in the cryogenic container assembly 30 can be the gaseous cooling medium, such that the superconducting coil 41 is immersed in the gaseous cooling medium. Consequently, the cooling capacity of the refrigerating machine 20 can be reduced, and the recovery cost of the superconducting coil 41 after multiple quenches can also be lowered, so as to reduce the magnetic training cost and consumption of the liquid cooling medium. When the superconducting coil 41 operates normally, the cooling medium in the cryogenic container assembly 30 can be a liquid cooling medium such as liquid helium, such that the superconducting coil 41 is immersed in the liquid cooling medium. Consequently, the superconducting coil 41 is cooled enough to ensure the stable operation. In an embodiment, the protecting module is connected to the superconducting coil 41, and is configured to protect the superconducting coil 41 when the superconducting coil 41 suffers a quench, so as to provides a security assurance for an operation of the superconducting coil 41 and ensure a safety of the superconducting magnet system 100.

In this embodiment, the first container end I I I and the second container end I are spaced apart. The second container end I is communicated with the first container end I I I through the first connecting tube I I, such that the cooling medium in the second container end I can be conveyed to the first container end I I I through the first connecting tube I I to cool the superconducting coil 41. Meanwhile, since the first container end I I I and the first connecting tube I I are in communication only through the first connecting tube I I, an input area and a working area of the cooling medium can be separated effectively, so as to ensure the stability of the cryogenic device 10. Also, since the refrigerating machine 20 is arranged at the second container end I, and the superconducting coil 41 is arranged at the first container end I I I, it can prevent various electrical components arranged at the second container end I and the refrigerating machine 20 from being affected by electromagnetic interference of the superconducting coil 41. In this case, the superconducting magnet system does not require magnetic shielding, simplifying the structure and reducing costs.

In addition, in the superconducting magnet system 100 provided herein, the refrigerating machine 20 is taken as a cooling source, liquid helium is taken as the cooling medium, and a "gas-liquid" non-evaporation self-circulation is formed in the superconducting magnet system 100. Consequently, high operating cost and inconvenience caused by the evaporation of liquid helium in the prior art are overcome.

The superconducting magnet system 100 can ensure a stability of the cryogenic device 10, reduce an electromagnetic interference of the superconducting coil 41 to the refrigerating machine 20 and various electrical components arranged at the second container end I, thus the superconducting magnet system is free from magnetic shielding and has reduced costs. Meanwhile, during a forging of magnetism, the superconducting coil 41 can be cooled by circulating the gaseous cooling medium to reduce the recovery cost after subjecting to multiple times of quench. During normal operation, the superconducting coil 41 can be cooled by immersion in the liquid cooling medium to ensure a superconducting magnet is cool enough and in a stable operation.

In an embodiment, as shown in FIG. 1, the cryogenic container assembly 30 includes a Dewar 31, a cold shield 32 and a liquid helium container 33 are nested in sequence from outside to inside. The Dewar 31, the cold shield 32 and liquid helium container 33 are separated from each other. A first vacuum cavity 301 is defined between an inner surface of the Dewar 31 and an outer surface of the cold shield 32. A second vacuum cavity 302 is defined between an inner surface of the cold shield 32 and an outer surface of the liquid helium container 33. The liquid helium container 33 is filled with the cooling medium.

In an embodiment, as shown in FIG. 1, the Dewar 31 includes a first Dewar portion 311, a second Dewar portion 312 and a second connecting tube 313. The first Dewar portion 311 is connected to the second Dewar portion 312 through the second connecting tube 313. The cold shield 32 includes a first cold shield portion 321, a second cold shield portion 322 and a third connecting tube 323. The first cold shield portion 321 is connected to the second cold shield portion 322 through the third connecting tube 323. The liquid helium container 33 includes a first liquid helium container portion 331, a second liquid helium container portion 332 and a fourth connecting tube 333. The first liquid helium container portion 331 is connected to the second liquid helium container portion 332 through the fourth connecting tube 333.

Figure 3:
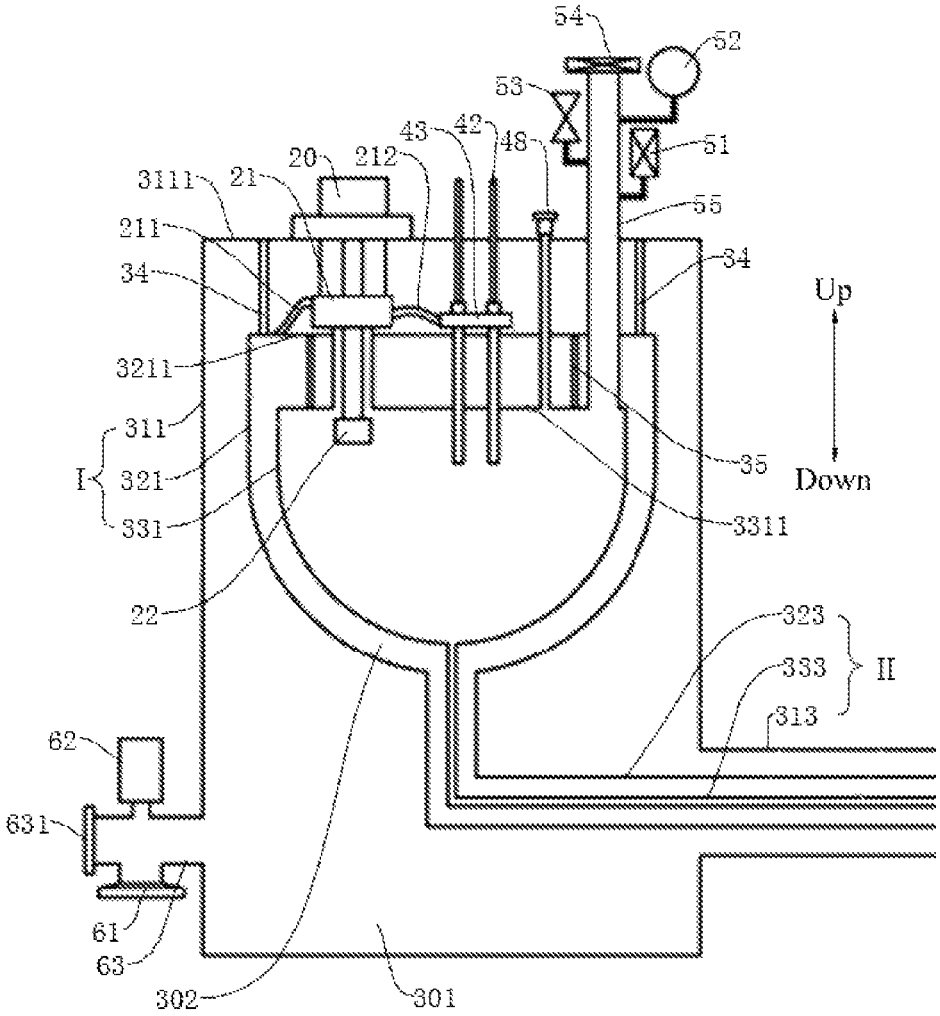
FIG. 3 schematically depicts a second container end of a cryogenic container assembly according to an embodiment of the present disclosure.

Referring to FIGS. 1 and 3, the first liquid helium container portion 331 is nestedly arranged inside the first cold shield portion 321. The first cold shield portion 321 is nestedly arranged inside the first Dewar portion 311. The first Dewar portion 311, the first cold shield portion 321 and the first liquid helium container portion 331 together form the second container end I of the cryogenic container assembly 30.

Figure 4:
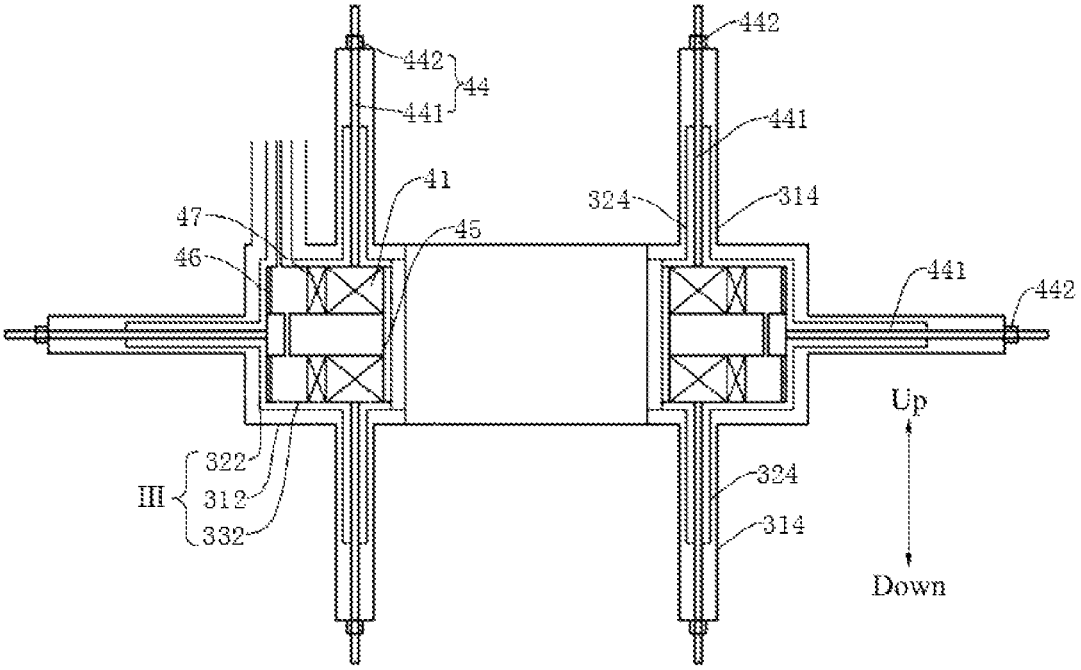
FIG. 4 schematically depicts a first container end of the cryogenic container assembly according to an embodiment of the present disclosure.

Referring to FIGS. 1, 3 and 4, the second connecting tube 313, the third connecting tube 323 and the fourth connecting tube 333 are nested in sequence from outside to inside to form the first connecting tube the first connecting tube I I of the cryogenic container assembly 30.

Referring to FIG. 3, in an embodiment, the first Dewar portion 311, the first cold shield portion 321 and the first liquid helium container portion 331 are cylindrical. A bottom of the first Dewar portion 311 is flat. A top of the first Dewar portion 311 is sealedly connected to a first flange 3111, where the first flange 3111 is flat. A bottom of the first cold shield portion 321 is a downward depressed spherical shape. A top of the first cold shield portion 321 is sealedly connected to a second flange 3211, where the second flange 3211 is flat. A bottom of the first liquid helium container portion 331 is a downward depressed spherical shape. A top of the first liquid helium container portion 331 is sealedly connected to a third flange 3311, where the third flange 3311 is flat.

In an embodiment, a first support rod 34 is arranged between and respectively connected to the first flange 3111 and the second flange 3211. The first cold shield portion 321 is hanged in the first Dewar portion 311 through the first support rod 34. The first cold shield portion 321 and an inner surface of the first Dewar portion 311 are spaced apart. In an embodiment, the first support rod 34 extends vertically. Multiple first support rods 34 can be provided. The first support rods 34 are arranged circumferentially around the second flange 3211 and spaced apart. In an embodiment, the first support rods 34 are stainless steel tube.

In an embodiment, a second support rod 35 is arranged between and respectively connected to the second flange 3211 and the third flange 3311. The first liquid helium container portion 331 is hanged in the first cold shield portion 321 through the second support rod 35. The first liquid helium container portion 331 and an inner surface of the first cold shield portion 321 are spaced apart. In an embodiment, the second support rod 35 extends vertically. Multiple second support rods 35 can be provided. The second support rods 35 are arranged circumferentially around the third flange 3311 and spaced apart. The second support rods 35 are stainless steel tube.

Figure 5:
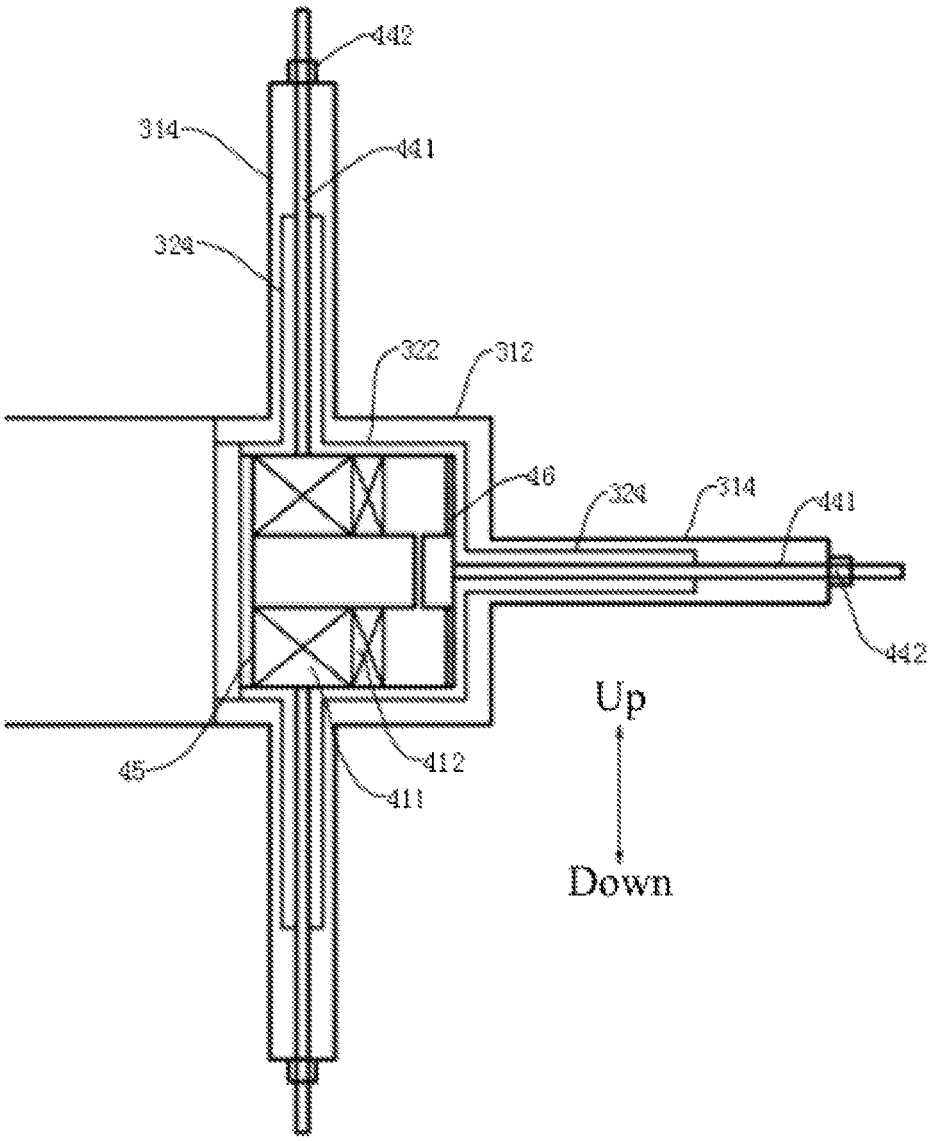
FIG. 5 a partially enlarged view of the first container end in FIG. 4.

Referring to FIGS. 4 and 5, the second Dewar portion 312, the second cold shield portion 322 and the second liquid helium container portion 332 are nested in sequence from outside to inside to form the first container end I I I of the cryogenic container assembly 30. As shown in FIG. 4, in an embodiment, the second Dewar portion 312, the second cold shield portion 322 and the second liquid helium container portion 332 are hollow and cylindrical.

In an embodiment, as shown in FIGS. 1 and 3, the superconducting magnet system 100 further includes a pressure relief assembly 50. The pressure relief assembly 50 is a pressure sensor 51, a pressure gauge 52, a safety valve 53, a cryogenic explosive actuated valve 54 or a combination thereof. That is, the pressure relief assembly 50 includes the pressure sensor 51, the pressure gauge 52, the safety valve 53 or the cryogenic explosive actuated valve 54; or the pressure relief assembly 50 includes any two or more of any combination of the pressure sensor 51, the pressure gauge 52, the safety valve 53 and the cryogenic explosive actuated valve 54. Preferably, the pressure relief assembly 50 includes the pressure sensor 51, the pressure gauge 52, the safety valve 53 and the cryogenic explosive actuated valve 54. Further, a pressure pipe 55 is connected to the first liquid helium container portion 331. The pressure pipe 55 successively passes through the first cold shield portion 321 and the first Dewar portion 311. The pressure sensor 51, the pressure gauge 52, the safety valve 53 and the cryogenic explosive actuated valve 54 are arranged on the pressure pipe 55 and placed outside the first Dewar portion 311.

In an embodiment, as shown in FIGS. 1 and 3, the superconducting magnet system 100 further includes a vacuum safety assembly 60. The vacuum safety assembly 60 is a vacuum explosive actuated valve 61, a vacuum gauge 62 or a combination thereof. That is, the vacuum safety assembly 60 is the vacuum explosive actuated valve 61 or the vacuum gauge 62; or includes the vacuum explosive actuated valve 61 and the vacuum gauge 62. The vacuum safety assembly 60 is arranged on the first Dewar portion 311.

In an embodiment, the vacuum safety assembly 60 further includes a vacuum-pumping port 631. For example, a vacuum tube 63 is connected to the first Dewar portion 311. The vacuum explosive actuated valve 61 and the vacuum gauge 62 of the vacuum safety assembly 60 are arranged at the vacuum tube 63. An end of the vacuum tube 63 far away from the first Dewar portion 311 forms the vacuum-pumping port 631. When assembling the cryogenic container assembly 30, a pumping assembly can be connected to the vacuum-pumping port 631 and configured to vacuumize the first vacuum cavity 301 and the second vacuum cavity 302.

In an embodiment, as shown in FIG. 3, the refrigerating machine 20 includes a primary cold head 21. The primary cold head 21 is arranged inside the first vacuum cavity 301. The primary cold head 21 is configured to cool the first cold shield portion 321 by means of thermal conduction. Specifically, the primary cold head 21 is arranged at an upper side of the second flange 3211. The primary cold head 21 is connected to the first cold shield portion 321 through a copper sheet 211, that is, the primary cold head 21 and the first cold shield portion 321 perform thermal transmission through the copper sheet 211.

In an embodiment, as shown in FIGS. 1 and 3, the superconducting device 40 further includes a current lead 42. The current lead 42 is arranged at the second container end I and connected in series with the superconducting coil 41. The current lead 42 is configured to connect the superconducting coil 41 to a superconducting power supply to perform excitation and demagnetization on the superconducting coil 41.

In an embodiment, since heat is generated during an operation of the superconducting device 40 with current passing through the current lead 42, the current lead 42 is provided with a heat sink 43. In an embodiment, the primary cold head 21 cools the heat sink 43 of the current lead 42 by means of thermal conduction. That is, the primary cold head 21 is connected to the heat sink 43 of the current lead 42 to perform a heat exchange between the primary cold head 21 and the heat sink 43 to cool the heat sink 43, so as to cool the current lead 42. In an embodiment, the primary cold head 21 is connected to the heat sink 43 through a copper braid 212.

In an embodiment, as shown in FIG. 3, the refrigerating machine 20 further includes a secondary cold head 22. The secondary cold head 22 is arranged inside the first liquid helium container portion 331. The secondary cold head 22 is configured to cool the cooling medium in the liquid helium container 33. In an embodiment, the cooling medium in the liquid helium container 33 is liquid helium. That is, the secondary cold head 22 is configured to cool helium gas in the liquid helium container 33 to form a low temperature helium gas or liquid helium which flows to the first container end I I I, such that a temperature of the second cold shield portion 322 of the first container end I I I is lower than 4.5 K. In this embodiment, the refrigerating machine 20 is taken as a cooling source for the liquid helium in the liquid helium container 33, which cools the superconducting magnet by means of a self-circulation of liquid helium in the liquid helium container 33 and requires no additional replenishment of liquid helium or helium gas, overcoming the high operation cost and inconvenience caused by evaporation of liquid helium in the prior art and reducing operating costs.

Figure 2:
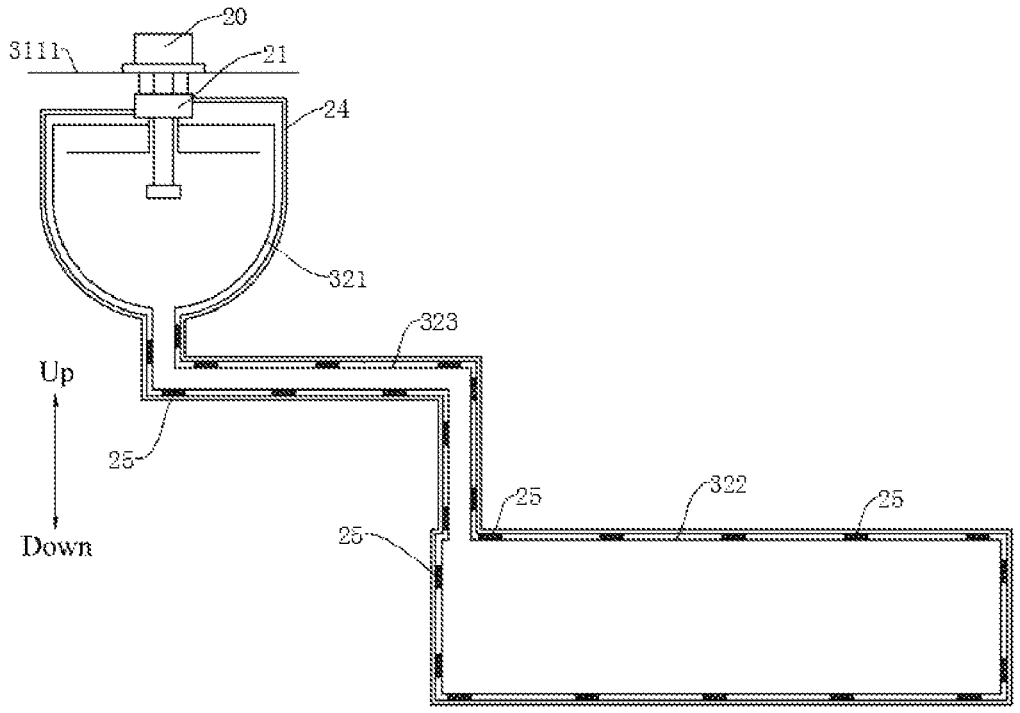
FIG. 2 schematically depicts a refrigerating machine and a cold shield according to an embodiment of the present disclosure.

In an embodiment, as shown in FIGS. 1-2, the refrigerating machine 20 further includes a heat exchange tube 24 configured to perform heat exchange between the primary cold head 21 and the secondary cold head 22. The heat exchange tube 24 is filled with the cooling medium. The heat exchange tube 24 extends along the third connecting tube 323 and an outer surface of the second cold shield portion 322 to form a heat exchange loop. The primary cold head 21 cools the third connecting tube 323 and the second cold shield portion 322 through the heat exchange tube 24 and the cooling medium in the heat exchange tube 24. In an embodiment, the cooling medium of the heat exchange loop is nitrogen hydrogen or neon. Specifically, after the cooling medium is subjected to exothermic condensation to be liquid in the primary cold head 21, the cooling medium flows out from the primary cold head 21 and into the heat exchange tube 24, so as to cool the third connecting tube 323 and the second cold shield portion 322 connected to the third connecting tube 323. In the above cooling process, the cooling medium thermally vaporized into a gaseous state and then back to the primary cold head 21 and recondenses to liquid, so as to make the heat exchange loop. Thus, the third connecting tube 323 and the second cold shield portion 322 are quickly and uniformly cooled.

In an embodiment, the heat exchange tube 24 can extend in a circuitous manner on an outer surface of the third connecting tube 323 and that of the second cold shield portion 322. In an embodiment, the heat exchange tube 24 can completely wrapped around the outer surface of the third connecting tube 323 and that of the second cold shield portion 322. In an embodiment, the heat exchange tube 24 is connected to the third connecting tube 323 and the second cold shield portion 322 through a thermal conducting part 25, that is, the heat exchange tube 24 makes heat exchange with the third connecting tube 323 and the second cold shield portion 322 through the thermal conducting part 25. Multiple thermal conducting parts 25 can be provided and arranged spaced apart along an extension direction of the heat exchange tube 24.

Referring to FIGS. 1, 4 and 5, in an embodiment, the superconducting device 40 further includes a pull rod assembly 44. The pull rod assembly 44 is connected to the second liquid helium container portion 322, and configured to adjust a position of the second liquid helium container portion 322, so as to adjust a position of the superconducting coil 41 arranged inside the second liquid helium container 332.

Referring to FIGS. 4 and 5, in an embodiment, the pull rod assembly 44 includes multiple pull rod groups. Each rod group includes multiple pull rods 441 arranged in the same plane. Planes in which the pull rod groups located are perpendicular to each other. That is, an angle between planes where the pull rod groups locate is 90°. One end of each of the pull rods 441 is fixedly arranged on the second liquid helium container portion 332. The other end of each of the pull rods 441 passes through the second cold shield portion 322, and the second Dewar portion 312 and is provided with an adjustment nut 442. The adjustment nut 442 is configured to fix each pull rod 441 to the second Dewar portion 312, and to adjust a position of the second Dewar portion 312 relative to the pull rods 441 in an axial direction of the pull rods 441, so as to adjust a position of the second Dewar portion 312 relative to the second liquid helium container portion 332 in the axial direction of the pull rods 441, and then adjust the position of the superconducting coil 41 arranged inside the second liquid helium container 332. A displacement adjustment of the pull rods 441 does not exceed 6 mm.

For example, the pull rod assembly 44 includes four pull rod groups, and each pull rod group includes three pull rods 441. The three pull rods 441 are in the same plane. The first container end I I I is a hollow cylinder. The four pull rod groups are arranged at an upper end surface, a lower end surface, and two sides of the first container end I I I, respectively. Angels between four planes of the four pull rod groups are 90°.

In an embodiment, as shown in FIGS. 4 and 5, the second Dewar portion 312 is connected to multiple Dewar pull rod portions 314 extended outwards. The Dewar pull rod portions 314 are communicated with the second Dewar portion 312. The second cold shield portion 322 is connected to multiple cold shield pull rod portions 324 extended outwards. The cold shield pull rod portions 324 are communicated with the second cold shield portion 322. One Dewar pull rod portion 314 corresponds to one cold shield pull rod portion 324, and one cold shield pull rod portion 324 is arranged inside one Dewar pull rod portion 314. In an embodiment, the cold shield pull rod portions 324 are in one-to-one correspondence to the pull rods 441. One pull rod 441 is arranged inside one cold shield pull rod portion 324, and one end of the pull rod 441 extends through one end of the cold shield pull rod portion 324 into the second cold shield portion 322 and then fixedly connected to the second liquid helium container portion 332 arranged in the second cold shield portion 322. The other end of the pull rod 441 passes through the other end of the cold shield pull rod portion 324 and an outer surface of the Dewar pull rod portion 314, and then extends to the outer surface of the Dewar pull rod portion 314. The other end of the pull rod 441 is provided with the adjustment nut 442. By screwing the adjusting nut 442, a position of the pull rod 441 can be adjusted, so as to adjust positions of the second cold shield portion 322 and the second liquid helium container portion 332.

In an embodiment, as shown in FIGS. 4 and 5, the superconducting coil 41 includes first coil 411 and a second coil 412 arranged along a radial direction. The first coil 411 is arranged radially inside the second coil 412. A copper-to-superconductor ratio of a superconducting wire of the second coil 412 is greater than that of a superconducting wire of the first coil 411. The copper-to-superconductor ratio is a volume ratio of copper to superconducting material in a superconducting wire. Thus, the superconducting wire of the first coil 411 has a lower copper-to-superconductor ratio and the superconducting wire of the second coil 412 has a higher copper-to-superconductor ratio. Since in the superconducting coil 41, a coil arranged inside is in a high magnetic field region and a coil arranged relative outside is in a relatively low magnetic field region, the coil arranged inside uses the superconducting wire with lower copper-to-superconductor ratio and the coil arranged relative outside uses the superconducting wire with higher copper-to-superconductor ratio, so that a manufacturing cost of the superconducting coil 41 can be significantly reduced.

In an embodiment, the copper-to-superconductor ratio of the superconducting wire of the first coil 411 is 1.3-8, such as 1.5, 2, 2.5, 3, 3.5, 4, 5 and 6. In an embodiment, the copper-to-superconductor ratio of the superconducting wire of the second coil 412 is 8-12, such as 8, 8.5, 9, 9.5, 10, 10.5, 11, 11.5 and 12. Therefore, superconducting wires with different copper-to-superconductor ratio can be selected for different magnetic field regions, significantly reducing the manufacturing cost of superconducting coil 41.

Referring to FIGS. 4 and 5, the superconducting device 40 is arranged inside the second liquid helium container portion 332. The superconducting coil 41 is densely wound on a frame 45. The superconducting coil 41 is a Wire-In-Channel (WIC) superconducting wire (superconducting cores welded in metal or alloy grooves). The superconducting coil 41 includes 2-4 sub-coils. The WIC superconducting wire of the superconducting coil 41 is wound with tension and the tension is 10-100 MPa. In an embodiment, the superconducting coil 41 is bound by a binding thread 47 which is high strength aluminum alloy wire. The binding thread 47 is wound with tension and the tension is 10-150 MPa. After wound, the superconducting coil 41 is subjected to vacuum pressure impregnation. A plate 46 is arranged outside the binding thread 47. A low temperature helium gas or liquid helium is provided between the plate 46 and the binding thread 47 to cool the superconducting coil 41.

In an embodiment, the superconducting magnet system 100 further includes a superconducting power supply. The superconducting power supply is connected to the superconducting coil 41 through the current lead 42. The superconducting power supply perform excitation and demagnetization on the superconducting coil 41.

Figure 6:
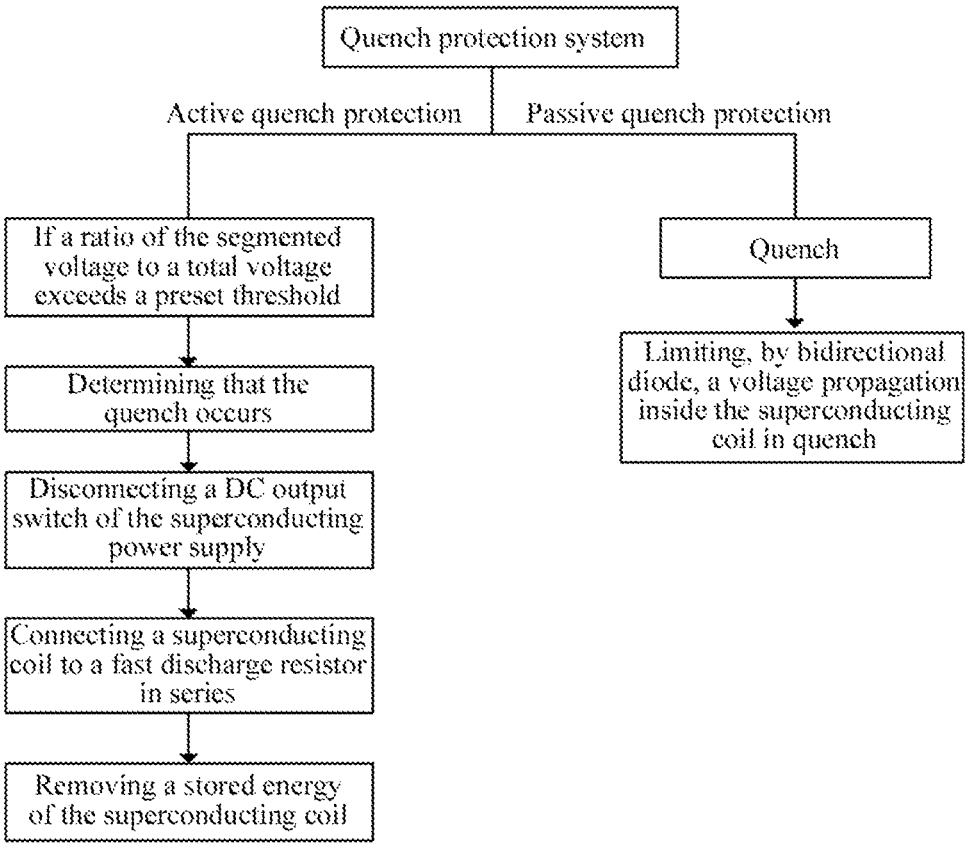
FIG. 6 is a flow chart of quench protection of the superconducting magnet system according to an embodiment of the present disclosure.

Referring to FIG. 6, in an embodiment, the protecting module includes a fast discharge resistor. The fast discharge resistor is connected in parallel to two ends of the superconducting power supply. A resistance of the fast discharge resistor is 0.2-0.3Ω, such as 0.5, 0.8, 1.5, 2 and 2.5Ω. The superconducting magnet system 100 further includes a controller. The controller is configured to disconnect the superconducting coil 41 from the superconducting power supply if the superconducting coil 41 suffers a quench, so as to enable the superconducting coil 41 to be connected in series with the fast discharge resistor. Thus, the fast discharge resistor can transfer part of a stored energy of the superconducting coil 41 if the superconducting coil 41 suffers a quench, thus effectively protecting the superconducting coil 41.

Referring to FIG. 6, in an embodiment, the controller is configured to determine that the superconducting coil 41 is suffering a quench when a ratio of a segmented voltage to a total voltage of the superconducting coil 41 exceeds a preset threshold. Specifically, the superconducting coil 41 includes multiple section coils. A segmented voltage of the section coils and a total voltage of the superconducting coil 41 are detected in real-time. A ratio of the segmented voltage to the total voltage is calculated. The superconducting coil 41 is suffering a quench when the ratio of the segmented voltage to the total voltage exceeds a preset threshold. A DC output switch of the superconducting power supply is turned off to allow the superconducting coil 41 to be connected in series with the fast discharge resistor, such that the stored energy of the superconducting coil 41 is removed, securing the superconducting coil 41 and actively protecting the superconducting coil when the superconducting coil 41 is suffering a quench.

Referring to FIG. 6, in an embodiment, the superconducting coil 41 includes multiple section coils, and the protecting module includes a bidirectional diode. The bidirectional diode is arranged in parallel at two ends of each of the section coils. The bidirectional diode is configured to limit a voltage propagation inside the superconducting coil 41 in quench, protecting the superconducting magnet system 100, so as to passively protect the superconducting magnet system 100.

Referring to FIGS. 1-6, the superconducting magnet system 100 for cyclotron is provided.

Specifically, as shown in FIG. 1, the superconducting magnet system 100 includes the cryogenic device 10, the superconducting device 40, the superconducting power supply and a quench protecting module.

As shown in FIG. 1, the cryogenic device 10 includes the refrigerating machine 20 and the cryogenic container assembly 30. The cryogenic container assembly 30 includes the Dewar 31, the cold shield 32 and the liquid helium container 33. A vacuum environment is defined between an inner side of the Dewar 31 and an outer side of the liquid helium container 33. The cryogenic container assembly 30 includes the first container end I I I, the first connecting tube I I and the second container end I. The first connecting tube I I is configured to connect the first container end I I I to the second container end I.

The first Dewar portion 311, the first cold shield portion 321 and the first liquid helium container portion 331 of the second container end I arranged inside the first cold shield portion 321 are all cylindrical, and are nested in sequence from outside to inside. A bottom of the first liquid helium container portion 331 is concave. A hollow stainless steel tube as the first support rod 34 is provided between the first flange 3111 and the second flange 3211, and configured to support the first cold shield portion 321. A bottom-hollow stainless steel tube as the second first support rod 35 is provided between the second flange 3211 and the third flange 3311 and configured to support the first liquid helium container portion 331.

The second container end I is provided with the current lead 42, an aviation connector 48, the pressure sensor 51, the pressure gauge 52, the safety valve 53, the cryogenic explosive actuated valve 54, the vacuum explosive actuated valve 61, the vacuum tube 62 and the vacuum-pumping port 631.

The refrigerating machine 20 is arranged at the second container end I. The primary cold head 21 of the refrigerating machine 20 is connected to the first cold shield portion 321 through the copper sheet 211, and cools the first cold shield portion 321 by means of thermal conduction. The primary cold head 21 is connected to the heat sink 43 through the copper braid 212 and cools the heat sink 43 of the current lead 42 by means of thermal conduction. The secondary cold head 22 is configured to cool the helium gas in the liquid helium container 33 to form a low temperature helium gas or liquid helium which flows to the first container end I I I, such that a temperature of the second cold shield portion 322 of the first container end I I I is lower than 4.5 K.

The primary cold head 21 cools the third connecting tube 323 and the second cold shield portion 322 through the heat exchange tube 24. Specifically, the heat exchange tube 24 is communicated with the primary cold head 21. The heat exchange tube 24 is in good thermal contact with the third connecting tube 323 and the second cold shield portion 322 through the thermal conducting part 25. A working medium in the heat exchange tube 24 is nitrogen hydrogen or neon. During heat exchange, a liquid working medium formed in the primary cold head 21 flows into the heat exchange tube 24 and is configure to cool the third connecting tube 323 and the second cold shield portion 322. Then a gas working medium formed in the heat exchange tube 24 back to the primary cold head 21 to recondenses to liquid working medium. Such that the heat exchange loop is formed, thereby rapidly and uniformly cooling the third connecting tube 323 and the second cold shield portion 322.

The second Dewar portion 312, the second cold shield portion 322 and the second liquid helium container portion of the first container end I I I are all hollow and cylindrical, and are nested in sequence from outside to inside. The superconducting device 40 is arranged at the first container end I I I. The superconducting device 40 includes the superconducting coil 41, the pull rod assembly 44, the frame 45, the plate 46 and the binding thread 47. The pull rod assembly 44 includes twelve pull rods 441 and twelve adjustment nuts 442, where one adjustment nut 442 corresponds to one pull rod 441. Three pull rods 441 are grouped into a rod group. Axes of each rod group are located in the same plane. Regarding the rod group, one is perpendicular to an upper end surface of a hollow cylinder of the first container end I I I; one is perpendicular to a lower end surface of the hollow cylinder of the first container end I I I; and the remaining one is perpendicular to a side of the hollow cylinder of the first container end I I I. Angels between planes of the rod groups are 90°. The pull rods 441 are configured to adjust a position of the superconducting coil 41, and a displacement adjustment of the pull rods is 0-6 mm. The pull rods 441 can bear a load of 2-20 tons.

The second Dewar portion 312 is provided with the Dewar pull rod portion 314. The second cold shield portion 322 is provided with the cold shield pull rod portion 324. The Dewar pull rod portion 314 is sealedly connected to the second Dewar portion 312. One end of the cold shield pull rod portion 324 is connected to the pull rod 441. The other end of the cold shield pull rod portion 324 is connected to the second cold shield portion 322. The pull rod 441 is connected to the second cold shield portion 322. The pull rod 441 supports the second cold shield portion 322 and the second cold shield portion 322. By turning the adjusting nut 442, a position of the pull rod 441 is adjusted, so as to adjust a position of the second cold shield portion 322 and the position of the second liquid helium container portion 332.

The superconducting coil 41 is located in the second liquid helium container portion 332 of the first container end I I I. The superconducting coil 41 is densely wound on the frame 45. The superconducting coil 41 is a WIC superconducting wire and includes 2-4 sub-coils. The WIC superconducting wire is wound with tension and the tension is 10-100 MPa. A copper-to-superconductor ratio of a WIC superconducting wire arranged inside in a high magnetic field region is lower than a copper-to-superconductor ratio of a WIC superconducting wire arranged relative outside in a relatively low magnetic field region. Specifically, the copper-to-superconductor ratio of the WIC superconducting wire arranged inside is 1.3-8. The copper-to-superconductor ratio of the superconducting wire arranged outside is 8-12. The superconducting coil 41 is connected in series with the current lead 42. the superconducting coil 41 is bound by a binding thread 47 which is high strength aluminum alloy wire. The binding thread 47 is wound with tension and the tension is 10-150 MPa. After wound, the superconducting coil 41 is subjected to vacuum pressure impregnation. A plate 46 is arranged outside the binding thread 47. A low temperature helium gas or liquid helium is provided between the plate 46 and the binding thread 47 to cool the superconducting coil 41. During operating the superconducting magnet system 100, a helium gas by heat absorption of the low temperature helium gas or liquid helium returns to the second container end I and condenses to low temperature helium gas or liquid helium through the secondary cold head 22, making a helium gas-liquid self-circulation with no additional helium or liquid helium.

The superconducting power supply is connected to the current lead 42, and performs excitation and demagnetization on the superconducting coil 41. A rate of excitation and demagnetization are adjustable. The superconducting coil 41 excitation to rated current can provide a magnetic field of about 3.5 T, which can meet a magnetic field requirement of a 240 MeV cyclotron.

The superconducting power supply has a quench detection function and can automatically cut off the power output after detection of quench. The superconducting power supply is connected in parallel to the fast discharge resistor. The fast discharge resistor with a resistance of 0.2-0.3Ω can transfer part of a stored energy when the superconducting coil 41 is suffering a quench.

A process of the quench protection of the superconducting magnet system 100 is described below. The quench protection of the superconducting magnet system 100 includes active quench protection and passive quench protection.

For the active quench protection, the superconducting power supply monitors the segmented voltage and the total voltage in real time through three potential lines respectively at two ends and center of the superconducting coil 41. If a ratio of the segmented voltage to the total voltage exceeds the preset threshold, the superconducting coil 41 is determined in quench. After the superconducting coil 41 is determined in quench, the DC output switch of the superconducting power supply is turned off to allow the superconducting coil 41 to be connected in series with the fast discharge resistor, such that the stored energy of the superconducting coil 41 is removed and the superconducting coil 41 is protected.

For the passive quench protection, each section coil of the superconducting coil 41 is connected in parallel to the bidirectional diode. The bidirectional diode limits the voltage propagation inside the superconducting coil 41 in quench, protecting the superconducting magnet system 100.

The superconducting magnet system 100 provided herein performs a self-circulation of low-temperature working medium without additional liquid helium or gas helium, reducing an operation cost. Different cooling methods are used for different operation stages. During a forging of magnetism, the during a forging of magnetism, the superconducting magnet is cooled by circulating a low-temperature helium gas to reduce the recovery cost after multiple quenches. During normal magnet operation, the superconducting magnet is cooled by immersion in liquid helium to ensure the superconducting magnet is cool enough and in a stable operation. The refrigerating machine 20 and measuring equipment are arranged at the second container end I which is far away from the superconducting coil 41 to be free from electromagnetic interference, so as to reduce a magnetic shielding requirement or even free the superconducting magnet system 100 from magnetic shielding, thus simplifying a structure of the superconducting magnet system 100. Different copper-to-superconductor ratios of the superconducting wire are selected according to magnetic field strength, significantly reducing the manufacturing cost of the superconducting coil 41. The quench protection includes active quench protection and passive quench protection, which provides double protection for the superconducting magnet.

Another embodiment of the disclosure provides a cyclotron including the above-mentioned superconducting magnet system 100.

Configuration and operation of the cyclotron are known to those skilled in the art and will not be described in detail here.

By using the above-mentioned superconducting magnet system 100, the overall performance of the cyclotron is improved.

As used herein, terms "center", "vertical", "horizontal", "length", "width", "thickness", "top", "bottom", "front", "back", "left", "right", "vertical", "horizontal", "top", "bottom", "inside", "outside", "clockwise", "anticlockwise", "axial", "radial" and "circumferential" refer to orientational or positional relationship shown in the drawings, which are merely for better description of the present disclosure instead of indicating or implying that the device or element referred to must have a specific orientation, be constructed and operated in a specific orientation. Therefore, these terms should not be construed as a limitation to the present disclosure.

In addition, terms, such as "first" and "second", are illustrative, and should not be understood as indicating or implying a relative importance or the number of elements. Elements defined with "first" and "second" may explicitly or implicitly include at least one of the element. Unless otherwise specified, term "plurality of" should be understood as including two or more than two.

Unless otherwise specified, terms "arrange", "connect", "communicate", "fix" and so on should be understood in a broad sense, such as fixed connection, removable connection, or integral connection; mechanical connection, electrical connection, or communication; direct connection, or indirect connection through an intermediate medium; or connection within two components or an interaction relationship between two components.

Terms "an embodiment", "some embodiments", "example", "specific example" and "some examples" means that the specific features, structures, materials, or characteristics described in connection with the embodiment or example are included in at least one embodiment or example of the present application. The above terms do not have to be directed to the same embodiments or examples. Moreover, the specific features, structures, materials, or characteristics described may be combined in a suitable manner in any one or more embodiments or examples. The features of various implementing embodiments may be combined to form further embodiments of the disclosed concepts.

Described above are merely illustrative of the disclosure, and are not intended to limit the disclosure. Although the disclosure has been illustrated and described in detail above, it should be understood that those skilled in the art could still make modifications and changes to the embodiments of the disclosure. Those modifications, changes, replacements and variations made by those skilled in the art based on the content disclosed herein without departing from the scope of the disclosure shall fall within the scope of the present disclosure defined by the appended claims.

What is claimed is:

1. A superconducting magnet system for cyclotrons, comprising:

a cryogenic device;

a superconducting device; and a protecting module;

wherein the cryogenic device comprises a refrigerating machine and a cryogenic container assembly; the cryogenic container assembly is filled with a cooling medium; the cryogenic container assembly comprises a first container end, a first connecting tube and a second container end; a magnet is provided at the first container end; the refrigerating machine is arranged at the second container end, and configured to cooling the cooling medium in the cryogenic container assembly; and the first container end is communicated with the second container end through the first connecting tube;

the superconducting device comprises a superconducting coil; the superconducting coil is arranged in the first container end, and is immersed in the cooling medium in the first container end; and the cooling medium is a liquid cooling medium or a gaseous cooling medium;

the protecting module is connected to the superconducting coil, and is configured to protect the superconducting coil when the superconducting device suffers a quench;

the cryogenic container assembly comprises a Dewar, a cold shield and a liquid helium container nested in sequence from outside to inside; the Dewar, the cold shield and the liquid helium container are separated from each other; a first vacuum cavity is defined between an inner surface of the Dewar and an outer surface of the cold shield; a second vacuum cavity is defined between an inner surface of the cold shield and an outer surface of the liquid helium container; and the liquid helium container is filled with the cooling medium;

the Dewar comprises a first Dewar portion, a second Dewar portion and a second connecting tube; the first Dewar portion is connected to the second Dewar portion through the second connecting tube; the cold shield comprises a first cold shield portion, a second cold shield portion and a third connecting tube; the first cold shield portion is connected to the second cold shield portion through the third connecting tube; the liquid helium container comprises a first liquid helium container portion, a second liquid helium container portion and a fourth connecting tube; and the first liquid helium container portion is connected to the second liquid helium container portion through the fourth connecting tube;

the first liquid helium container portion is nestedly arranged inside the first cold shield portion, and the first cold shield portion is nestedly arranged inside the first Dewar portion; the first Dewar portion, the first cold shield portion and the first liquid helium container portion together form the second container end of the cryogenic container assembly; the second liquid helium container portion is nestedly arranged inside the second cold shield portion, and the second cold shield portion is nestedly arranged inside the second Dewar portion; and the second Dewar portion, the second cold shield portion and the second liquid helium container portion together form the first container end of the cryogenic container assembly;

the refrigerating machine comprises a primary cold head and a heat exchange tube configured to perform heat exchange with the primary cold head; the heat exchange tube is filled with the cooling medium; and the primary cold head is configured to cool the third connecting tube and the second cold shield portion through the heat exchange tube and the cooling medium in the heat exchange tube.

2. The superconducting magnet system of claim 1, further comprising:

a pressure relief assembly; and/or a vacuum relief assembly;

wherein the pressure relief assembly is a pressure sensor, a pressure gauge, a safety valve, a cryogenic explosive actuated valve or a combination thereof; a pressure pipe is connected to the first liquid helium container portion; the pressure pipe successively passes through the first cold shield portion and the first Dewar portion; and the pressure relief assembly is arranged on the pressure pipe and placed outside the first Dewar portion; and the vacuum relief assembly is a vacuum explosive actuated valve, a vacuum gauge or a combination thereof; and the vacuum relief assembly is arranged on the first Dewar portion.

3. The superconducting magnet system of claim 1, wherein the superconducting device further comprises a current lead; the current lead is arranged at the second container end, and connected in series with the superconducting coil; and the refrigerating machine further comprises a secondary cold head; the primary cold head is configured to cool the first cold shield portion and a heat sink of the current lead by means of thermal conduction; and the secondary cold head is configured to cool the cooling medium in the liquid helium container.

4. The superconducting magnet system of claim 1, wherein the superconducting device further comprises a pull rod assembly; and the pull rod assembly is connected to the second liquid helium container portion, and configured to adjust a position of the second liquid helium container portion.

5. The superconducting magnet system of claim 4, wherein the pull rod assembly comprises a plurality of pull rod groups; each of the plurality of pull rod groups comprises a plurality of pull rods arranged in the same plane; planes in which the plurality of pull rod groups are respectively located are perpendicular to each other; one end of each of the plurality of pull rods is fixedly arranged on the second liquid helium container portion, and the other end of each of the plurality of pull rods passes through the second cold shield portion and the second Dewar portion, and is provided with an adjustment nut; and the adjustment nut is configured to fix each of the plurality of pull rods to the second Dewar portion, and to adjust a position of the second liquid helium container portion relative to the second Dewar portion in an axial direction of each of the plurality of pull rods.

6. The superconducting magnet system of claim 1, further comprising:

a superconducting power supply;

wherein the superconducting power supply is connected to the superconducting coil through a current lead, and configured to perform excitation and demagnetization on the superconducting coil.

7. The superconducting magnet system of claim 6, wherein the protecting module comprises a fast discharge resistor; the fast discharge resistor is connected in parallel to two ends of the superconducting power supply; and a resistance of the fast discharge resistor is 0.2-0.3Ω; and the superconducting magnet system further comprises a controller; and the controller is configured to disconnect the superconducting coil from the superconducting power supply to allow the superconducting coil to be connected in series with the fast discharge resistor when the superconducting coil suffers a quench.

8. The superconducting magnet system of claim 7, wherein the controller is configured to determine that the superconducting coil is suffering a quench when a ratio of a segmented voltage to a total voltage of the superconducting coil exceeds a preset threshold.

9. The superconducting magnet system of claim 1, wherein the superconducting coil comprises a plurality of section coils; the protecting module comprises a bidirectional diode; and the bidirectional diode is arranged in parallel at two ends of each of the plurality of section coils.

10. A cyclotron, comprising the superconducting magnet system of claim 1.

11. The cyclotron of claim 10, wherein the superconducting magnet system further comprises:

a pressure relief assembly; and/or a vacuum relief assembly;

wherein the pressure relief assembly is a pressure sensor, a pressure gauge, a safety valve, a cryogenic explosive actuated valve or a combination thereof; a pressure pipe is connected to the first liquid helium container portion; the pressure pipe successively passes through the first cold shield portion and the first Dewar portion; and the pressure relief assembly is arranged on the pressure pipe and placed outside the first Dewar portion; and the vacuum relief assembly is a vacuum explosive actuated valve, a vacuum gauge or a combination thereof; and the vacuum relief assembly is arranged on the first Dewar portion.

12. The cyclotron of claim 10, wherein the superconducting device further comprises a current lead; the current lead is arranged at the second container end, and connected in series with the superconducting coil; and the refrigerating machine further comprises a secondary cold head; the primary cold head is configured to cool the first cold shield portion and a heat sink of the current lead by means of thermal conduction; and the secondary cold head is configured to cool the cooling medium in the liquid helium container.

13. The cyclotron of claim 10, wherein the superconducting device further comprises a pull rod assembly; and the pull rod assembly is connected to the second liquid helium container portion, and configured to adjust a position of the second liquid helium container portion.

14. The cyclotron of claim 13, wherein the pull rod assembly comprises a plurality of pull rod groups; each of the plurality of pull rod groups comprises a plurality of pull rods arranged in the same plane; planes in which the plurality of pull rod groups are respectively located are perpendicular to each other; one end of each of the plurality of pull rods is fixedly arranged on the second liquid helium container portion, and the other end of each of the plurality of pull rods passes through the second cold shield portion and the second Dewar portion, and is provided with an adjustment nut; and the adjustment nut is configured to fix each of the plurality of pull rods to the second Dewar portion, and to adjust a position of the second liquid helium container portion relative to the second Dewar portion in an axial direction of each of the plurality of pull rods.

15. The cyclotron of claim 10, wherein the superconducting magnet system further comprises:

a superconducting power supply;

wherein the superconducting power supply is connected to the superconducting coil through a current lead, and configured to perform excitation and demagnetization on the superconducting coil.

16. The cyclotron of claim 15, wherein the protecting module comprises a fast discharge resistor; the fast discharge resistor is connected in parallel to two ends of the superconducting power supply; and a resistance of the fast discharge resistor is 0.2-0.3Ω; and the superconducting magnet system further comprises a controller; and the controller is configured to disconnect the superconducting coil from the superconducting power supply to allow the superconducting coil to be connected in series with the fast discharge resistor when the superconducting coil suffers a quench.

17. The cyclotron of claim 16, wherein the controller is configured to determine that the superconducting coil is suffering a quench when a ratio of a segmented voltage to a total voltage of the superconducting coil exceeds a preset threshold.

18. The cyclotron of claim 10, wherein the superconducting coil comprises a plurality of section coils; the protecting module comprises a bidirectional diode; and the bidirectional diode is arranged in parallel at two ends of each of the plurality of section coils.

* * * * *